United States Patent [19]

Docherty et al.

[11] Patent Number: 4,672,759

[45] Date of Patent: Jun. 16, 1987

[54] ALPHABETIC DISPLAY

[75] Inventors: Brian Docherty; Stephen Lambley, both of Felixstowe, England

[73] Assignee: British Telecommunications plc, Great Britain

[21] Appl. No.: 838,433

[22] Filed: Mar. 10, 1986

Related U.S. Application Data

[63] Continuation of Ser. No. 668,784, Nov. 6, 1984, abandoned.

[30] Foreign Application Priority Data

Nov. 7, 1983 [GB] United Kingdom ..... 8329704

[51] Int. Cl.[4] ..... G09F 19/04

[52] U.S. Cl. ..... 40/450; 40/452; 340/765; 58/50; 368/232; 434/160

[58] Field of Search ..... 40/447, 450, 451, 452; 340/765; 368/232, 233; 434/160

[56] References Cited

U.S. PATENT DOCUMENTS

| | | | |
|---|---|---|---|
| 2,963,220 | 12/1960 | Kosten et al. | 40/450 |
| 3,977,179 | 8/1976 | Bachmann | 40/450 |
| 4,040,048 | 8/1977 | Lien | 40/451 |
| 4,058,919 | 11/1977 | Wakabayashi | 40/451 |
| 4,092,638 | 5/1978 | Ripley | 340/336 |
| 4,163,230 | 7/1979 | Konii | 40/450 |
| 4,184,319 | 1/1980 | Kumata | 58/50 |

FOREIGN PATENT DOCUMENTS

| | | | |
|---|---|---|---|
| 1462307 | of 0000 | United Kingdom | 40/450 |

*Primary Examiner*—Robert Peshock
*Assistant Examiner*—Wenceslao J. Contreras
*Attorney, Agent, or Firm*—Nixon & Vanderhye

[57] ABSTRACT

Digits of a multi digit alphanumeric display have eight segments, viz a conventional seven segment arrangement plus an eighth. The attitude/position of the eighth segment differs from digit to digit, the pattern of variation being selected so that a limited repertoire of words and phrases can be displayed without the provision of full alphanumeric capability on all digits.

13 Claims, 5 Drawing Figures divert all to oper divert busy to 2101 callback on 1314 divert no reply 4101 call held recover call accept return conference wait on busy cancel all

Prog

Look reconnect line incorrect input

Featurephone input extn

1234567890

ALPHABETIC DISPLAY

This is a continuation of application Ser. No. 678,784 filed Nov. 6, 1984 now abandoned.

FIELD OF THE INVENTION

The present invention relates to display devices for the display of numbers, with, in addition a limited capability for displaying letters of the alphabet.

BACKGROUND OF THE INVENTION

For numeric displays, the seven-segment display device, shown in FIG. 1, is well known. The segments (formed for example using a liquid crystal device (LCD) or light-emitting diode (LED) techniques) are selectively energised to form the desired digit. Usually a decimal point is included, and a multi digit display can be driven by a multiplexed arrangement in which eight lines are connected each to the corresponding segment electrode of all digits, with select lines each connected to the common electrode of a respective digit.

A few letters of the alphabet can be displayed using the seven segment display (as illustrated for P, H and t) which can be useful for some applications, but even using a mixture of upper and lower case letters, a complete alphabet cannot be constructed.

For a full alphanumeric display, a 16-segment display has been proposed (shown in FIG. 2, with the letters A, B, X illustrated). This is substantially more expensive than the 7-segment version, in terms both of the construction of the device and of the drive circuitry, where the number of lines to be driven is doubled. Also, the letters tend to be displayed in the right hand half of each digit position, with consequent uneven character spacing.

Another proposal (see U.S. Pat. No.: 4,184,319) is a display for a digital watch in which a pair of display digits have respectively thirteen and twelve (or ten) segments permitting a restricted repertoire of letters so that abbreviations of the months of the year can be displayed. U.S. Pat. No.: 4,092,638 shows a similar arrangement with a ten-segment/eight segment pair for indicating days of the week.

SUMMARY OF THE INVENTION

The present invention provides a display device including a plurality of digits each having seven segments arranged in a figure of eight configuration, some or all of the said digits having additional segments assuming ones of a number of different shapes and/or positions, in which each of the digits having more than seven segments has only eight segments, the disposition of the eight segments being selected such that a desired repertoire of words can be displayed.

The inventors have recognized that the addition of an eighth segment to a seven segment display permits all letters of the Roman alphabet to be displayed, and that by providing a sufficient number of digits and appropriately selecting the shapes and locations of the eight segments, any desired repertoire of words can be accommodated. Naturally not all the words can be displayed in the same position, but—as will be seen from the example described below—judicious choice of these variables can provide substantial "overlap" of the word positions and permit a significant number of words or phrases to be displayed without an unduly large number of digits being required.

The minimum number of digits will be determined by the words to be displayed, for a practical display six or seven digits at least will be required. Additional digits, with seven (or fewer) segments can also be included, if required.

If desired, decimal points or other ancillary features could be included, but in a preferred arrangement these are absent, with each digit having only eight segments and hence only eight independently actuable display elements, so that conventional 8-line integrated circuit drivers and the like (as used for a 7-segment plus decimal point) can be employed.

BRIEF DESCRIPTION OF THE DRAWINGS

One embodiment of the invention will now be described with reference to the accompanying drawings, in which.

DETAILED DESCRIPTION

Figure 1:
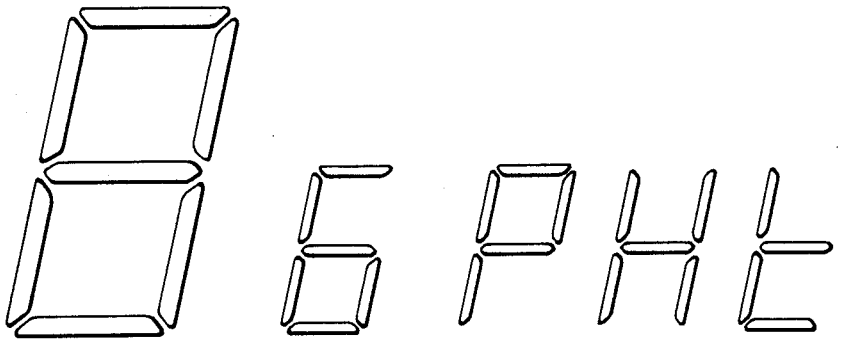
FIGS. 1 and 2 show conventional segment displays.
Figure 2:
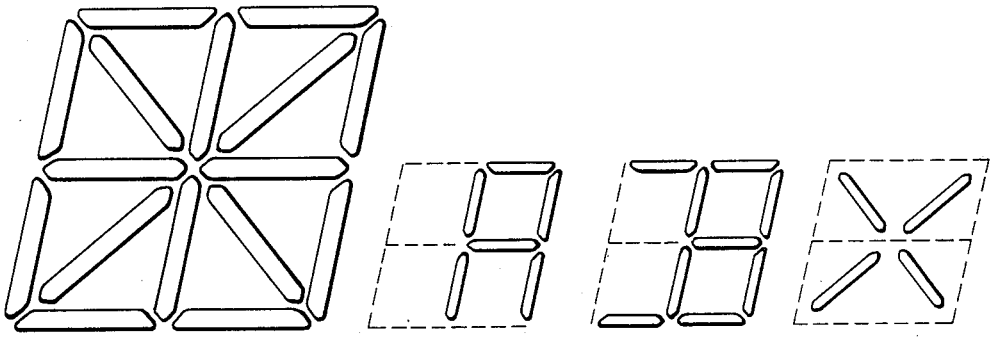
Figure 3:
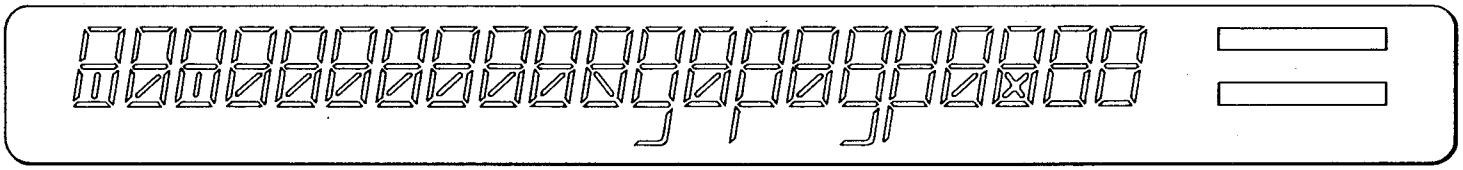
FIG. 3 shows a display device according to the invention.

FIG. 3 shows a display device according to one embodiment of the invention. It comprises twenty-one digits. Each digit has seven segments arrayed in the manner of a conventional 7-segment display, in order that digits from 0 to 9 can be displayed in any position.

All but two of the digits have each an eighth segment the disposition of which is not the same for all digits.

Figure 4:
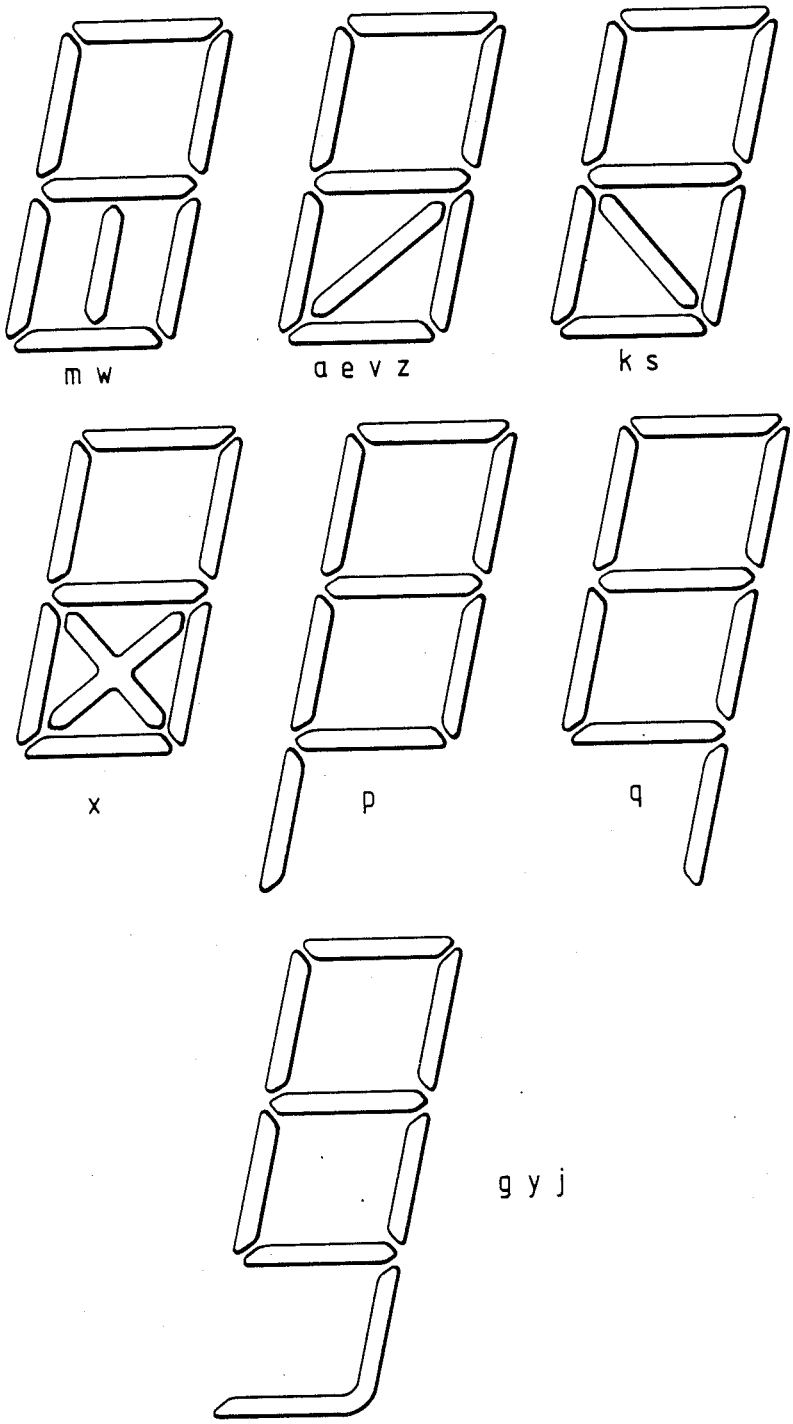
FIG. 4 shows details of some segment positions which can be employed in the display device.

The seven segments have the capacity to display (as well as numbers 0 to 9) the following lower case letters—b c d f h i l n o r t u. Digit 1 has its eighth segment forming a vertical line in the centre of the lower half of the digit, and permits representation of the letters m and w. Similarly, other alternatives for the eighth segment provide a different set of additional letters; these are shown in FIG. 4 for seven alternatives. Note that the x and the tail of the g/y although consisting of two lines, constitute a single segment since they cannot be energised independently of one another.

A display incorporating all seven types of digit has the capability of displaying any of the lower case letters a–z (and a few upper case). Only six are present in FIG. 3 since the letter q is not required in this particular embodiment. Of course, one is restricted as to the digit positions that can be assumed by certain letters, and therefore the distribution of the six types is selected so as to permit display of a repertoire of desired messages within the minimum number of digits (or within the number of digits required for a numeric display, if this is greater).

To take a simple example, assume that the words north, south, east and west were to be displayed (with the first seven segments to be in the usual seven segment position, so that numbers can be displayed, too). North does not require an eighth segment and can thus appear anywhere in the display. South requires a backward stroke in its first position; assume this to appear in the nth digit of the display. Each requires for "e a s" two forward strokes and one backward. Since the nth position has a backward stroke, east would appear in positions $n-2$ to $n+1$, or $n+1$ to $n+4$. The result for west is identical, but the two cannot assume the same position since "w e" and "e a" have different requirements.

So we have (taking an arbitary position for north):

| | | |
|---|---|---|
| north | or | north |
| south | | south |
| east | | east |
| west | | west |
| // /O | | / //O |

requiring seven digits with the eighth segments as indicated below the words lists ("0" indicates that that an eighth segment is not needed).

Figure 5:
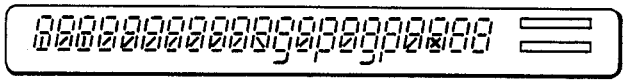
FIG. 5 shows a repertoire of words which can be displayed by the device of FIG. 3.

The twenty-one digit display of FIG. 3 is intended for use in a telephone, and FIG. 5 shows with a list of seventeen typical messages which it can display, along with the digits 0 to 9. The messages also include one or two upper case letters not requiring an eighth segment. It will be realised, of course, that the invention is not limited to the lower case letters given in the example and additional upper case letters (or other symbols) could be provided as well as (or instead of) the lower cases ones, using the techniques described.

We claim:

1. A multi-digit display device to be driven by an 8 line driver circuit such as that used for driving a conventional 7 segment plus decimal point display, said display device being capable of displaying capital and lower case letters and also being capable of displaying a multi-word message composed from a predetermined repertoire of words, said display device comprising:

an array of digit displays each having seven individually controllable display segments arranged in a figure-of-eight configuration;

an additional controllable display segment located in each of a first plurality of said array of digit displays and having different shapes and positions located within said figure-of-eight configuration, said first plurality of digital displays having display segments including said additional display segment which are energizable in differnt combinations corresponding to each of the vowels in the alphabet and a first set of consonants;

an additional controllable display segment, located in each of a second plurality of said array of digit displays and having different shapes and positions located below said figure-of-eight configuration, said second plurality of digit displays having display segments including said additional display segment located in second plurality which are selectively energizable in different combinations corresponding to a second set of consonants, the dispositions of the digit displays having eight display segments and the arrangement of said additional segments defining a multi-digit display device capable of displaying a predetermined repertoire of words at different positions on said device.

2. A display device according to claim 1 which also includes further digits each having seven or fewer segments.

3. A display device according to claim 1 or 2 wherein at least one of said additional segments in said first plurality of said digit displays extends vertically in the center of a lower aperture of its associated said figure-of-eight configuration.

4. A display device according to claim 1 wherein at least one of said additional segments extends diagonally across a lower aperature of its associated said figure-of-eight configuration.

5. A display device according to claim 1 wherein at least one of said additional segments is an x-shaped segment within a lower aperture of its associated said figure-of-eight configuration.

6. A display device according to claim 1 wherein a maximum of eight display segments are provided on any of said digit displays.

7. A display device according to claim 1, wherein said array includes at least 10 digit displays.

8. A method for displaying according to claim 7, wherein an eighth display element is disposed in at least 10 display locations.

9. A multi-digit display device to be driven by an 8 line driver circuit such as that used for driving a conventional 7 segment plus decimal point display, said display device being capable of displaying capital and lower case letters and being capable of displaying multi-word messages composed from a predetermined repertoire of words, said display device comprising:

an array of consecutively positioned digit displays, each comprising seven individually controllable display segments in a figure-of-eight configuration, and a first additional controllable display segment located in each of a first plurality of said array of digit displays and having different shapes and positions located within said figure-of-eight configuration, said first plurality of digital displays having display segments which are energizable in different combinations corresponding to each of the vowels in the alphabet and a first set of consonants;

a second additional controllable display segment located in each of a second plurality of said array of digit displays and having different shapes and positions located below said figure-of-eight configuration, said second plurality of digit displays having display segments which are selectively energizable in different combinations corresponding to a second set of consonants, a maximum of eight segments being located in any digit display, the location and sequence of said first and second linear display segments providing the capability of displaying said predetermined repertoire of words.

10. A device as in claim 8 wherein at least two of said first additional segments have different orientations within said lower aperture and at least two of said second additional segments have a different orientation below said figure-of-eight configuration to thereby allow different digit displays to display different alphabetic characters.

11. A device as in claim 9 wherein the said first additional segments assume one of three different shapes including: (1) a vertical line, (2) a horizontal line, and (3) an "x" shape.

12. A method for displaying a predetermined repertoire of words using a multi-digit display to be driven by an 8 line driver circuit such as that used for driving a conventional 7 segment plus decimal point display, said display device having no more than eight individually controllable display segments at each digit display location, said display device being capable of displaying capital and lower case letters, said method comprising the steps of:

disposing a plurality of seven individually controllable display elements in a figure-of-eight configuration at each digit display location; and selectively disposing an eighth controllable display segment in each of a first plurality of said display locations within said figure-of-eight configuration, such that said first plurality of display locations are energizable in different combinations corresponding to each of the vowels in the alphabet and a first set of consonants;

selectively disposing an eighth controllable display segment in each of a second plurality of said display locations below said figure-of-eight configuration, such that said second plurality of display locations are selectively energizable in different combinations corresponding to a second set of consonants, said selectively disposing steps being performed so as to permit display of said predetermined repertoire of words in differing positions along said display.

13. A multi-digit alphanumeric display device to be driven by an 8 line driver circuit such as that used for driving a conventional 7 segment plus decimal point display, said display being capable of displaying both capital and lower case letters and being capable of displaying a limited predetermined repertoire of words, said device comprising:

an array of consecutively located alphabetic digit display positions, each digit display position including seven individually controllable display segments disposed in a figure-of-eight configuration;

an additional controllable display segment located in each of a first plurality of said array of digit displays and having different shapes and positions located within said figure-of-eight configuration, said first plurality of digit displays having display segments which are energizable in different combinations corresponding to each of the vowels in the alphabet and a first set of consonants;

an additional controllable display segment, located in each of a second plurality of said array of digit displays, and having different shapes and positions located below said figure-of-eight configuration, said second plurality of digit displays having display segments which are selectively energizable in different combinations corresponding to a second set of consonants, the consecutive arrangement of said eighth display segments permitting display of all said predetermined repertoire of words on the device but at different overlapping locations along said device.

* * * * *